US011139551B2

(12) United States Patent
Choi et al.

(10) Patent No.: US 11,139,551 B2
(45) Date of Patent: Oct. 5, 2021

(54) CHIP ANTENNA MODULE

(71) Applicant: SAMSUNG ELECTRO-MECHANICS CO., LTD., Suwon-si (KR)

(72) Inventors: Seong Hee Choi, Suwon-si (KR); Sang Jong Lee, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 162 days.

(21) Appl. No.: 16/506,289

(22) Filed: Jul. 9, 2019

(65) Prior Publication Data

US 2020/0091583 A1 Mar. 19, 2020

(30) Foreign Application Priority Data

Sep. 18, 2018 (KR) ..... 10-2018-0111749
Nov. 7, 2018 (KR) ..... 10-2018-0136072

(51) Int. Cl.

| | |
|---|---|
| ***H01Q 1/22*** | (2006.01) |
| ***H01Q 9/04*** | (2006.01) |
| ***H01Q 1/24*** | (2006.01) |
| ***H01Q 1/38*** | (2006.01) |
| ***H01Q 9/40*** | (2006.01) |

(Continued)

(52) U.S. Cl.

CPC ..... *H01Q 1/2283* (2013.01); *H01Q 1/243* (2013.01); *H01Q 1/38* (2013.01); *H01Q 1/48* (2013.01); *H01Q 5/10* (2015.01); *H01Q 9/045* (2013.01); *H01Q 9/0421* (2013.01); *H01Q 9/40* (2013.01)

(58) Field of Classification Search

CPC ..... H01Q 1/2283; H01Q 1/2291; H01Q 1/22; H01Q 1/38; H01Q 1/24; H01Q 1/243; H01Q 1/48; H01Q 5/10; H01Q 9/04; H01Q 9/0407; H01Q 9/0457; H01Q 9/0421; H01Q 9/045; H01Q 9/40; H01Q 21/00; H01Q 21/0025; H01Q 21/0093; H01Q 21/06; H01Q 21/065; H01Q 21/28; H01Q 5/36; H01Q 5/364; H01Q 5/378; H01Q 9/0414; H01Q 9/42; H01Q 19/10

See application file for complete search history.

(56) References Cited

U.S. PATENT DOCUMENTS 9,257,751 B2 * 2/2016 Felic ..... H01Q 9/045
10,483,618 B2 * 11/2019 Park ..... H01L 21/6835

(Continued)

FOREIGN PATENT DOCUMENTS

| | | |
|---|---|---|
| JP | 2000-232315 A | 8/2000 |
| JP | 4240953 B2 | 3/2009 |
| KR | 10-0962574 B1 | 6/2010 |

*Primary Examiner* — Tho G Phan

(74) *Attorney, Agent, or Firm* — NSIP Law

(57) ABSTRACT

A chip antenna module includes: a substrate including a feed wiring layer to provide a feed signal, a feeding via connected to the feed wiring layer, and a dummy via separated from the feed wiring layer; and a chip antenna disposed on a first surface of the substrate and including a body portion formed of a dielectric substance, a radiating portion that extends from a first surface of the body portion and is connected to the feeding via and the dummy via, and a grounding portion that extends from a second surface of the body portion opposite the first surface of the body portion.

9 Claims, 7 Drawing Sheets

(51) Int. Cl.
*H01Q 5/10* (2015.01)
*H01Q 1/48* (2006.01)

(56) References Cited

U.S. PATENT DOCUMENTS 10,594,019 B2 * 3/2020 Baks ..... H01Q 9/0407
2019/0221917 A1 * 7/2019 Kim ..... H01Q 19/10

* cited by examiner

CHIP ANTENNA MODULE

CROSS-REFERENCE TO RELATED APPLICATIONS

This application claims the benefit under 35 USC 119(a) of Korean Patent Application No. 10-2018-0111749 filed on Sep. 18, 2018 and Korean Patent Application No. 10-2018-0136072 filed on Nov. 7, 2018 in the Korean Intellectual Property Office, the entire disclosures of which are incorporated herein by reference for all purposes.

BACKGROUND

1. Field

The following description relates to a chip antenna module.

2. Description of Background

A 5G communications system is implemented in higher frequency (mmWave) bands, e.g., 10 GHz to 100 GHz bands, to achieve higher data transfer rates. In order to reduce propagation loss of radio waves and increase a transmission distance of radio waves, beamforming, large-scale multiple-input multiple-output (MIMO), full-dimensional MIMO (FD-MIMO), array antennas, analog beamforming, and large-scale antenna techniques are discussed in the 5G communications system.

Mobile communications terminals such as a cellular phone, a personal digital assistant (PDA), a navigation device, a notebook computer, and the like, supporting wireless communications, have been developed to have functions such as code division multiple access (CDMA), a wireless local area network (WLAN), digital multimedia broadcasting (DMB), near field communications (NFC), and the like. One of the most important components enabling these functions is an antenna.

Since a wavelength is as small as several millimeters in a millimeter wave communications band, it is difficult to use a conventional antenna. Therefore, a chip antenna module, suitable for the millimeter wave communications band, is required.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

An aspect of the present disclosure is to provide a chip antenna module that can be used in a GHz communications band.

In one general aspect, a chip antenna module includes: a substrate including a feed wiring layer to provide a feed signal, a feeding via connected to the feed wiring layer, and a dummy via separated from the feed wiring layer; and a chip antenna disposed on a first surface of the substrate and including a body portion formed of a dielectric substance, a radiating portion that extends from a first surface of the body portion and is connected to the feeding via and the dummy via, and a grounding portion that extends from a second surface of the body portion opposite the first surface of the body portion.

The chip antenna may output a wireless frequency signal having two resonance frequencies.

The feeding via may pass through the feed wiring layer and extend toward a second surface of the substrate opposite the first surface of the substrate.

Two resonance frequencies of a wireless frequency signal output from the chip antenna may be determined by an extended length of the feeding via.

The feeding via and the dummy via may be spaced apart from each other in an extending direction of the radiating portion, and the feeding via and the dummy via may be connected in parallel with the radiating portion.

Two resonance frequencies of a wireless frequency signal output from the chip antenna may be determined by a distance between the feeding via and the dummy via.

The dummy via may be bonded to a dummy wiring layer disposed on a second surface of the substrate opposite the first surface of the substrate and extending along the second surface of the substrate.

Two resonance frequencies of a wireless frequency signal output from the chip antenna may be determined by an extended length of the dummy wiring layer.

The feeding via may be connected to the radiating portion through a feeding pad disposed on the first surface of the substrate and bonded to the radiating portion, and the dummy via may be connected to the radiating portion through a dummy pad disposed on the first surface of the substrate and bonded to the radiating portion.

In another general aspect, a chip antenna module includes: a substrate; and a chip antenna disposed on a first surface of the substrate to output a wireless frequency signal having two resonance frequencies. The chip antenna includes a body portion formed of a dielectric substance, a radiating portion that extends from a first surface of the body portion, and a grounding portion that extends from a second surface of the body portion opposite the first surface of the body portion.

The substrate may include a feed wiring layer configured to provide a feed signal, a feeding via connected to the feed wiring layer, and a dummy via separated from the feed wiring layer.

The feeding via and the dummy via may be connected to the radiating portion to form the two resonance frequencies of the wireless frequency signal output from the chip antenna.

The feeding via may pass through the feed wiring layer and extends toward a second surface of the substrate opposite the first surface of the substrate.

The feeding via and the dummy via may be spaced apart from each other in an extending direction of the radiating portion, and the feeding via and the dummy via may be bonded in parallel with the radiating portion.

The dummy via may be bonded to a dummy wiring layer disposed on a second surface of the substrate opposite the first surface of the substrate and extending along the second surface of the substrate.

The feeding via may be connected to the radiating portion through a feeding pad disposed on the first surface of the substrate and bonded to the radiating portion, and the dummy via may be connected to the radiating portion through a dummy pad disposed on the first surface of the substrate and bonded to the radiating portion.

In another general aspect, a chip antenna module includes: a substrate including a dummy via extending through the substrate from a first surface toward a second surface and a feeding via extending through the substrate parallel to the dummy via and spaced apart from the dummy via; and a chip antenna connected to the dummy via and the feeding via to output a wireless frequency signal based on a distance between the feeding via and the dummy via.

The chip antenna may include a dielectric body portion, a radiating portion that extends from a first surface of the body portion and is connected to the feeding via and the dummy via, and a grounding portion that extends from a second surface of the body portion opposite the first surface of the body portion.

A thickness of the body portion may be less than a thickness of the radiating portion and less than a thickness of the grounding portion.

The substrate may include an insulating protective layer and the chip antenna may be connected to the dummy via and the feeding via through the insulating protective layer.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
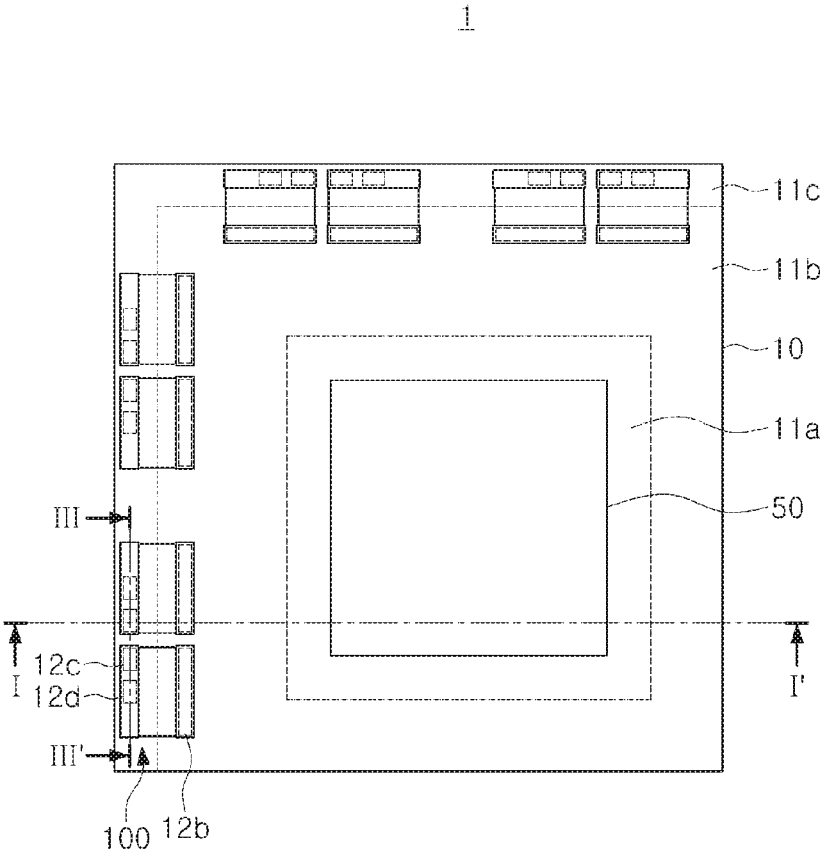
FIG. 1 is a plan view of a chip antenna module according to an example.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Herein, it is noted that use of the term "may" with respect to an example or embodiment, e.g., as to what an example or embodiment may include or implement, means that at least one example or embodiment exists in which such a feature is included or implemented while all examples and embodiments are not limited thereto.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

A chip antenna module described herein can operate in a radio frequency region, and for example, can operate in a frequency band between 3 GHz and 30 GHz. The chip antenna module may be mounted in an electronic device configured to receive or transmit and receive a radio signal. For example, the chip antenna may be mounted in a portable telephone, a portable notebook PC, a drone, or the like.

Figure 2:
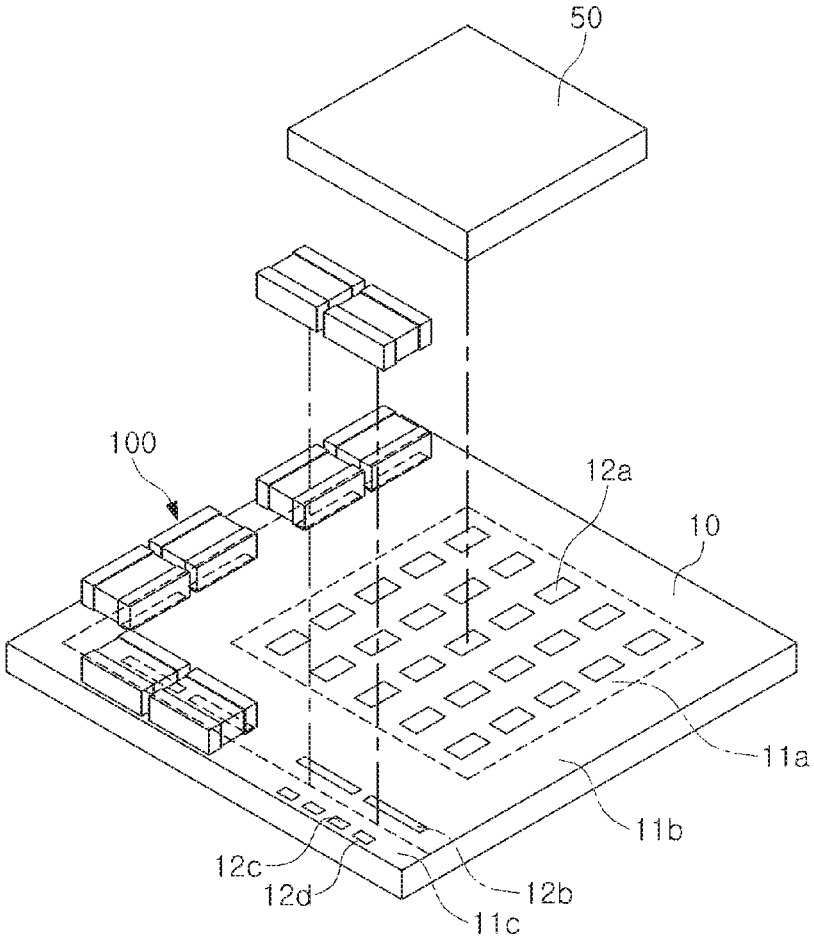
FIG. 2 is an exploded perspective view of the chip antenna module illustrated in FIG. 1.
Figure 3:
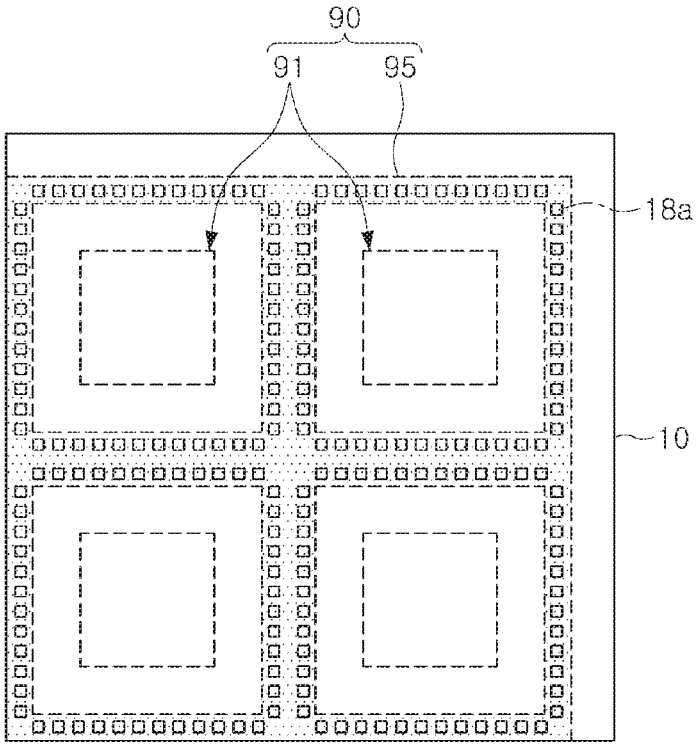
FIG. 3 is a bottom view of the chip antenna module illustrated in FIG. 1.
Figure 4:
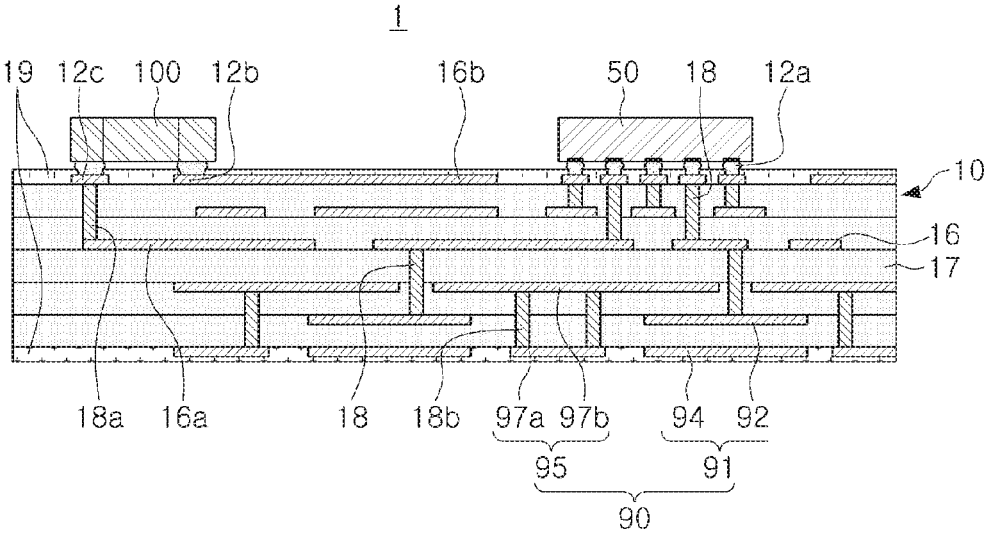
FIG. 4 is a cross-sectional view taken along line I-I" of FIG. 1.

FIG. 1 is a plan view of a chip antenna module according to an example, FIG. 2 is an exploded perspective view of a chip antenna module illustrated in FIG. 1, and FIG. 3 is a bottom view of the chip antenna module illustrated in FIG. 1. Furthermore, FIG. 4 is a cross-sectional view taken along line I-I' of FIG. 1.

Referring to FIG. 1 through FIG. 4, a chip antenna module 1 includes a substrate 10, an electronic component 50, and a chip antenna 100.

The substrate 10 may be a circuit used in a wireless antenna, or a circuit board on which electronic components are mounted. For example, the substrate 10 may be a printed circuit board (PCB) containing at least one electronic component therein or including at least one electronic component mounted on a surface thereof. Accordingly, the substrate 10 may include a circuit wiring line electrically connecting electronic components.

The substrate 10 may be a multi-layered substrate in which a plurality of insulating layers 17 and a plurality of wiring layers 16 are repeatedly stacked one on top of the other. In some examples, the wiring layer 16 may be disposed on both surfaces of a single insulating layer 17.

The insulating layer 17 may be formed of an insulating material. Examples of the insulating material include but are not limited to thermosetting resin such as epoxy resin, thermoplastic resin such as polyimide, and resin in which the thermosetting resin or the thermoplastic resin is impregnated with inorganic filler in a core material such as glass fiber, glass cloth, and glass fabric, such as prepreg, Ajinomoto build-up film (ABF), FR-4, and bismaleimide triazine (BT). Alternatively, photo-imageable dielectric (PID) resin can be also used for the insulating layers 17.

The wiring layer 16 electrically connects the electronic component 50, which will be described below, to the patch antenna 90 and the chip antenna 100. Furthermore, the wiring layer 16 electrically connects the electronic component 50 or the patch antenna 90 and the chip antenna 100 to an external component.

The wiring layer 16 may be formed of a conductive material, such as copper (Cu), aluminum (Al), silver (Ag), tin (Sn), gold (Au), nickel (Ni), lead (Pb), titanium (Ti), and an alloy thereof.

Interlayer connection conductors 18 are disposed inside the insulating layers 17 to connect the stacked wiring layers 16 to each other.

An insulating protective layer 19 may be disposed on a surface of the substrate 10. The insulating protective layer 19 is disposed on at least one of an upper surface and a lower surface of the substrate 10 so as to cover and thereby protect both the insulating layer 17 and the wiring layer 16.

The insulating protective layer 19 may have an opening portion formed therein which exposes at least a portion of the wiring layer 16. The insulating protective layer 19 may contain an insulating resin and an inorganic filler. The insulating protective layer 19 may not contain glass fiber. For example, the insulating protective layer 19 may include a solder resist. A substrate of various types well known in the related art (for example, a printed circuit board, a flexible substrate, a ceramic substrate, a glass substrate, etc.) may be used for the substrate 10.

The upper surface of the substrate 10, herein referred to as first surface, may be divided into a component mounting region 11*a*, a grounding region 11*b*, and a feeding region 11*c*.

The component mounting region 11*a* is a region in which the electronic component 50 is mounted. The component mounting region 11*a* is disposed within the grounding region 11*b*, which will be described below. A plurality of connection pads 12*a* to which the electronic component 50 is electrically connected are disposed in the component mounting region 11*a*.

The grounding region 11*b* is a region in which a grounding wiring layer 16*b* is disposed. The grounding region 11*b* is disposed so as to surround the component mounting region 11*a*. Accordingly, the component mounting region 11*a* is disposed within the grounding region 11*b*.

One of the wiring layers 16 of the substrate 10 may be used as the grounding wiring layer 16*b*. Accordingly, the grounding wiring layer 16*b* may be disposed on an upper surface of an uppermost insulating layer 17 or may be disposed between two insulating layers 17 stacked one on top of the other.

In an example, the component mounting region 11 a is substantially rectangular in shape. Accordingly, the grounding region 11*b* is disposed in the shape of a rectangular ring that surrounds the component mounting region 11*a*. The shape of the component mounting region 11*a* may vary depending on examples.

Since the grounding region 11*b* is disposed along an edge of the component mounting region 11*a*, the connection pads 12*a* in the component mounting region 11*a* are electrically connected to an external component or other components through the interlayer connection conductors 18 passing through the insulating layers 17 of the substrate 10.

A plurality of grounding pads 12*b* are disposed in the grounding region 11*b*. When the grounding wiring layer 16*b* is disposed on the upper surface of the uppermost insulating layer 17, the grounding pads 12*b* may be formed by partially perforating the insulating protective layer 19 covering the grounding wiring layer 16*b*. Accordingly, in this case, the grounding pads 12*b* are formed as part of the grounding wiring layer 16*b*. However, the grounding wiring layer 16*b* is not limited to such a configuration and may be disposed between two insulating layers 17 stacked one on top of the other. In this case, the grounding pads 12*b* are disposed on top of an upper insulating layer 17 of the two insulating layers 17, and the grounding pads 12*b* and the grounding wiring layer 16*b* may be connected to each other through an interlayer connection conductor 18.

A grounding pad 12*b* is disposed to form a pair with a feeding pad 12*c*, which will be described below. Therefore, the grounding pad 12*b* is disposed adjacent to the feeding pad 12*c*.

The feeding region 11*c* is disposed outside the grounding region 11*b*. In an example, the feeding region 11*c* is disposed adjacent to two outer sides of the grounding region 11*b*. Accordingly, the feeding region 11*c* is disposed along an outer edge of the substrate 10. However, the configuration of the feeding region 11*c* is not limited thereto.

A plurality of feeding pads 12*c* are disposed in the feeding region 11*c*. The feeding pads 12*c* are disposed on an upper surface of the uppermost insulating layer 17 and are bonded to a radiating portion 130*a* (see FIG. 5) of the chip antenna 100.

The feeding pads 12*c* are electrically connected to the electronic component 50 or other components through a feeding via 18*a* passing through the insulating layer 17 and a feed wiring layer 16*a*. The feeding pads 12*c* receive a feed signal through the feeding via 18*a* and the feed wiring layer 16*a*.

The component mounting region 11*a*, the grounding region 11*b*, and the feeding region 11*c* are distinguished from one another by shapes or positions of the grounding wiring layer 16*b* disposed thereon. Also, the connection pads 12*a*, the grounding pads 12*b*, and the feeding pads 12*c* are externally exposed in the shape of pads through opening portions of the insulating protective layer 19.

The feeding pad 12*c* may be smaller than a length or area of a lower surface of the radiating portion 130*a*. A length or area of the feeding pad 12*c* may be less than or equal to a half of the length or area of the lower surface of the radiating portion 130*a* of the chip antenna 100.

A dummy pad 12*d* may be similar to the feeding pad 12*c* in terms of shape. Accordingly, the dummy pad 12*d* may be smaller than the length or area of the lower surface of the radiating portion 130*a*. A length or area of the dummy pad 12*d* may be less than or equal to a half of the length or area of the lower surface of the radiating portion 130*a* of the chip antenna 100.

The feeding pad 12*c* and the dummy pad 12*d* are spaced apart from each other in a length direction of the lower surface of the radiating portion 130*a*, and the lower surface of the radiating portion 130*a* may be bonded to the feeding pad 12*c* and the dummy pad 12*d*.

The patch antenna 90 is disposed on a lower surface of the substrate 10, herein referred to as a second surface. The patch antenna 90 is formed by the wiring layers 16 disposed on the substrate 10.

As illustrated in FIG. 3 and FIG. 4, the patch antenna 90 includes at least one feed portion 91 including a feed patch 92 and a radiating patch 94, and at least one grounding portion 95.

In the present example, the patch antenna 90 includes a plurality of feed portions 91 arranged on the second surface side of the substrate 10. In particular, in the present example, the patch antenna 90 is illustrated as including four feed portions 91 and one grounding portion 95, but is not limited to such a configuration.

The feed patch 92 is formed as a flat metal layer having a fixed area and is formed by a single conductive plate. The feed patch 92 may have a substantially polygonal structure, and has a rectangular shape in the present example but is not limited to such a configuration or shape. Alternatively, the feed patch 92 may be formed in other shapes such as a circular shape.

The feed patch 92 may be connected to the electronic component 50 through an interlayer connection conductor 18. More specifically, the interlayer connection conductor 18 may pass through a second grounding wiring layer 97*b*, which is described later, to be connected to the electronic component 50.

The radiating patch 94 is spaced apart from the feed patch 92 by a fixed distance and is formed as a single flat conductive plate having a fixed area. The radiating patch 94 has an identical or similar area as an area of the feed patch 92. For example, the radiating patch 94 may be formed to have an area larger than the area of the feed patch 92 and positioned to face the entire feed patch 92.

The radiating patch 94 is disposed closer to the second surface of the substrate 10 than the feed patch 92. Accordingly, the radiating patch 94 may be disposed on a lowermost wiring layer 16 of the substrate 10, and in this case, the radiating patch 94 is protected by the insulating protective layer 19 disposed on a lower surface of a lowermost insulating layer 17 of the substrate 10.

The grounding portion 95 is disposed so as to surround the feed portions 91. The grounding portion 95 includes a first grounding wiring layer 97*a*, the second grounding wiring layer 97*b*, and grounding vias 18*b*.

The first grounding wiring layer 97*a* is disposed on the same layer as the radiating patch 94. The first grounding wiring layer 97*a* is disposed in proximity to the radiating patch 94 so as to surround the radiating patch 94, and is spaced apart from the radiating patch 94 by a fixed distance.

The second grounding wiring layer 97*b* and the first grounding wiring layer 97*a* are disposed on different wiring layers 16 from each other. For example, the second grounding wiring layer 97*b* may be disposed between the feed patch 92 and the first surface of the substrate 10. In this case, the feed patch 92 is disposed between the radiating patch 94 and the second grounding wiring layer 97*b*.

The second grounding wiring layer 97*b* may be disposed on the entire surface of a single wiring layer 16. A portion of the second grounding wiring layer 97*b* may be removed for an interlayer connection conductor 18 connected to the feed patch 92 to pass through.

The grounding vias 18*b* are interlayer connection conductors electrically connecting the first grounding wiring layer 97*a* and the second grounding wiring layer 97*b* to each other, and are disposed so as to surround the feed patch 92 and the radiating patch 94. In the present example, the grounding vias 18*b* are arranged in a single column, but are not limited to such a configuration and may be variously modified. For example, the grounding vias 18*b* may be arranged in a plurality of columns in some examples. According to the configuration described above, the feed portion 91 is disposed within the grounding portion 95, which forms a shape similar to a container by virtue of the first grounding wiring layer 97*a*, the second grounding wiring layer 97*b*, and the grounding vias 18*b*.

The feed portion 91 of the patch antenna 90 radiates wireless signals in a thickness direction (in a downward direction, for example) of the substrate 10.

In the present example, the first grounding wiring layer 97*a* and the second grounding wiring layer 97*b* are not disposed on a region that faces the feed region (11*c* in FIG. 2) defined on the first surface of the substrate 10. This is for the purpose of reducing interference between the grounding portion 95 and the wireless signals radiated from the chip antenna 100, which will be described below. However, the first grounding wiring layer 97*a* and the second grounding wiring layer 97*b* are not limited to such a configuration.

Furthermore, although the present example describes a case in which the patch antenna 90 includes the feed patch 92 and the radiating patch 94, the configuration of the patch antenna 90 may be variously modified. For example, the patch antenna 90 may be configured to include only the feed patch 92 if so needed.

The electronic component 50 is mounted in the component mounting region 11*a*. The electronic component 50 may be bonded to the connection pads 12*a* in the component mounting region 11*a* by using a conductive adhesive.

Although the present example describes a single electronic component 50 mounted in the component mounting region 11*a*, a plurality of electronic components 50 may be mounted therein.

The electronic component 50 may include at least one active component and may further include, for example, a signal processing component transferring a feed signal to the radiating portion 130*a* of the antenna. The electronic component 50 may also include a passive component.

The chip antenna 100 is used for wireless communications in a frequency range of gigahertz and is mounted on the substrate 10 to receive feed signals from the electronic component 50 and externally radiate the feed signals.

The chip antenna 100 is formed in a substantially hexahedral shape. The chip antenna 100 is mounted on the substrate 10. The chip antenna 100 has one end bonded to the feeding pads 12*c* of the substrate 10 and the other end bonded to the grounding pads 12*b* of the substrate 10 by using a conductive adhesive such as solders.

Figure 5:
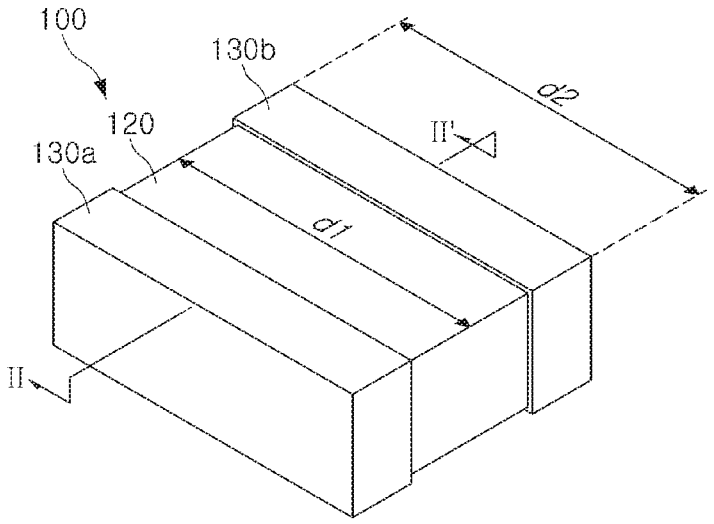
FIG. 5 is an enlarged perspective view of a chip antenna of the chip antenna module illustrated in FIG. 1.
Figure 6:
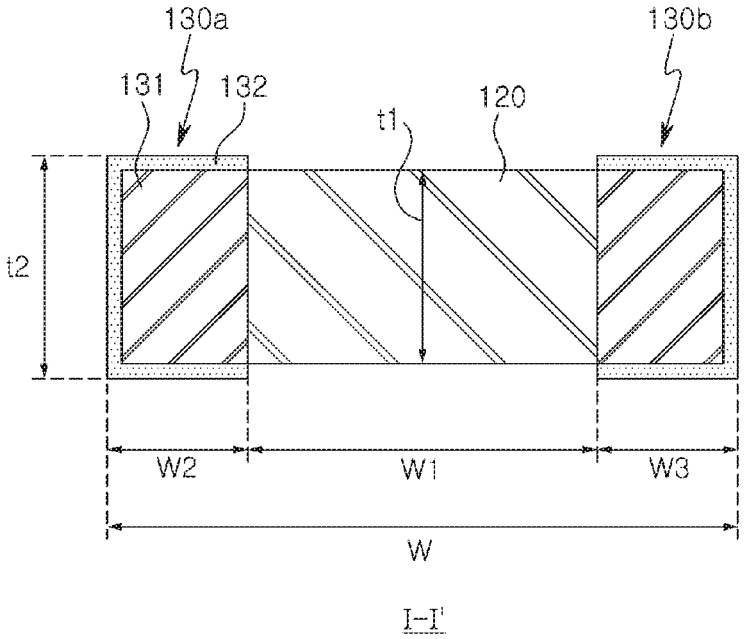
FIG. 6 is a cross-sectional view taken along line II-II' of FIG. 5.

FIG. 5 is an enlarged perspective view of a chip antenna of the chip antenna module illustrated in FIG. 1, and FIG. 6 is a cross-sectional view taken along line II-II' of FIG. 5.

The chip antenna 100 is formed in a substantially hexahedral shape. The chip antenna 100 is mounted on the substrate 10. The chip antenna 100 has one end bonded to one of the feeding pads 12*c* of the substrate 10 and the other end bonded to one of the grounding pads 12*b* of the substrate 10 by using a conductive adhesive such as solders.

Referring to FIG. 5 and FIG. 6, the chip antenna 100 includes a body portion 120, a radiating portion 130*a*, and a grounding portion 130*b*.

The body portion 120 is formed of a dielectric substance in a substantially hexahedral shape. For example, the body portion 120 may be formed of a polymer or a ceramic sintered body having a dielectric constant.

The chip antenna 100 is capable of operating in a 3-30 GHz frequency range.

The body portion 120 of the chip antenna 100 is formed of a material having a dielectric constant in the range of 3.5-25. The radiating portion 130*a* is bonded to the first surface of the body portion 120. The grounding portion 130*b* is bonded to the second surface of the body portion 120. The first surface and the second surface refer to two opposing surfaces of the body portion 120 formed in a substantially hexahedral shape.

In the present example, a width W1 of the body portion 120 is defined by a distance between the first surface of the body portion 120 and the second surface of the body portion 120. Accordingly, the direction from the first surface toward the second surface of the body portion 120 (or the direction from the second surface to the first surface of the body portion 120) is defined as a width direction of the body portion 120 of the chip antenna 100.

A width W2 of the radiating portion 130*a* and a width W3 of the grounding portion 130*b* are each defined as a distance in a width direction of the chip antenna 100. The width W2 of the radiating portion 130*a* refers to a shortest distance from a bonding surface of the radiating portion 130*a* bonded to the first surface of the body portion 120, to a surface of the radiating portion 130*a* opposing the bonding surface of the radiating portion 130*a*. The width W3 of the grounding portion 130*b* refers to a shortest distance from a bonding surface of the grounding portion 130*b* bonded to the second surface of the body portion 120, to a surface of the grounding portion 130*b* opposing the bonding surface of the grounding portion 130*b*.

The radiating portion 130*a* is bonded to the body portion 120 while making contact with only one surface among six surfaces of the body portion 120. Likewise, the grounding portion 130*b* is bonded to the body portion 120 while making contact with only one surface among six surfaces of the body portion 120. The radiating portion 130*a* and the grounding portion 130*b* are disposed only on the first and second surfaces of the body portion 120, and are disposed in parallel with each other with the body portion 120 interposed therebetween.

Chip antennas conventionally used in a low frequency band typically have a radiating portion and a grounding portion as thin films disposed on a lower surface of a body portion of a chip antenna, and thus have a relatively small distance between the radiating portion and the grounding portion, causing a loss of radio-frequency signals due to inductance. Furthermore, since the distance between the radiating portion and the grounding portion cannot be precisely controlled in such a conventional chip antenna during the manufacturing process thereof, it is difficult to accurately predict capacitance, which results in difficulties in controlling a resonance point and impedance tuning.

In contrast to such a conventional chip antenna, the chip antenna 100 according to the example disclosed herein includes the radiating portion 130*a* and the grounding portion 130*b*, each formed in the shape of a block and bonded to the first surface and the second surface of the body portion 120, respectively. In the present example, the radiating portion 130*a* and the grounding portion 130*b* are each formed in a substantially hexahedral shape having six surfaces, and more particularly, one surface among six surfaces of the radiating portion 130*a* is bonded to the first surface of the body portion 120, and one surface among six surfaces of the grounding portion 130*b* is bonded to the second surface of the body portion 120.

When the radiating portion 130*a* and the grounding portion 130*b* are bonded only to the first surface and the second surface of the body portion 120, respectively, the distance between the radiating portion 130*a* and the grounding portion 130*b* is defined solely by the size of the body portion 120, and thus, the aforementioned issues associated with the conventional chip antenna can be prevented.

Furthermore, the chip antenna 100 forms capacitance by virtue of the dielectric substance between the radiating portion 130*a* and the grounding portion 130*b* (for example, the body portion 120), and thus may be used in the configuration of a coupling antenna or to tune resonance frequencies.

The radiating portion 130*a* may be formed of the same material as the grounding portion 130*b*. Furthermore, the radiating portion 130*a* may have the same shape structure as the grounding portion 130*b*. In this case, the radiating portion 130*a* and the grounding portion 130*b* can be distinguished from each other by the type of pads bonded thereto when mounted on the substrate 10.

For example, in the chip antenna 100 according to the present example, a component bonded to the feeding pads 12*c* of the substrate 10 may function as the radiating portion 130*a*, while a component bonded to the grounding pads 12*b* of the substrate 10 may function as the grounding portion 130*b*. However, the configuration of the chip antenna 100 is not limited thereto.

The radiating portion 130*a* and the grounding portion 130*b* each include a first conductor 131 and a second conductor 132. The first conductor 131 is a conductor directly bonded to the body portion 120 and formed in the shape of a block. The second conductor 132 is disposed as a layer along a surface of the first conductor 131.

The first conductor 131 may be formed on one surface of the body portion 120 by a printing process or a plating process and may be formed of one selected from Ag, Au, Cu, Al, Pt, Ti, Mo, Ni, and W, or may be formed of an alloy of two or more selected therefrom. Alternatively, the first conductor 131 may be formed of conductive epoxy or conductive paste containing an organic substance such as polymer and glass, in metal material.

The second conductor 132 may be formed on a surface of the first conductor 131 by a plating process. Without being limited thereto, the second conductor 132 may be formed by having a nickel (Ni) layer and a tin (Sn) layer sequentially stacked one on top of the other, or by having a zinc (Zn) layer and a tin (Sn) layer sequentially stacked one on top of the other.

Referring FIG. 5 and FIG. 6, a thickness t2 of each of the radiating portion 130*a* and the grounding portion 130*b* is greater than a thickness t1 of the body portion 120. Also, a length d2 of each of the radiating portion 130*a* and the grounding portion 130*b* is greater than a length d1 of the body portion 120. The first conductor 131 has a thickness and a length that are identical to the thickness t1 and the length dl of the body portion 120, respectively.

Accordingly, each of the radiating portion 130*a* and the grounding portion 130*b* is formed thicker and longer than the body portion 120 by virtue of the second conductor 132 formed on the surface of the first conductor 131.

The chip antenna 100 in the present example can be used in a radio frequency band between 3 GHz and 30 GHz, and can be conveniently mounted in a thin portable device.

Since the radiating portion 130*a* and the grounding portion 130*b* are each in contact with only one surface of the body portion 120, resonance frequencies can be tuned conveniently. By controlling the size of the antenna, radiation efficiency of the antenna can be greatly enhanced. For example, by altering the length dl of the body portion 120 and the length d2 of each of the radiating portion 130*a* and the grounding portion 130*b,* resonance frequencies of the chip antenna 100 can be conveniently controlled.

However, in a case in which the chip antenna 100 only has a single resonance frequency, due to an extremely narrow pass band the chip antenna 100 may not be able to output a designed wireless frequency signal.

In an example, the radiating portion 130*a* of the chip antenna 100 is connected to the dummy pad 12*d* as well as to the feeding pad 12*c* to form an additional resonance frequency in addition to an inherent resonance frequency of the chip antenna 100, thereby enlarging the pass band.

Figure 7:
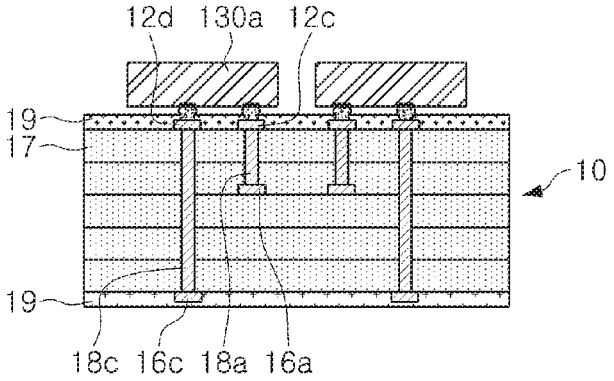
FIG. 7 is a cross-sectional view of a chip antenna module according to an example, taken along line III-III' of FIG. 1.

FIG. 7 is a cross-sectional view of a chip antenna module according to an example, taken along line III-Ill' of FIG. 1.

Referring to FIG. 1 and FIG. 7, a dummy pad 12*d* may be disposed adjacent to the feeding pad 12*c* and bonded to the radiating potion 130*a* of the chip antenna 100. A lower surface of the radiating portion 130*a* can be bonded to the feeding pad 12*c* and the dummy pad 12*d* by using bumps.

The dummy pad 12*d* may be formed smaller than the length or area of the lower surface of the radiating portion 130*a*. A length or area of the dummy pad 12*d* may be equal to or less than a half of the length or area of the lower surface of the radiating portion 130*a* of the chip antenna 100. For example, the dummy pad 12*d* may have the same length and area as the feeding pad 12*c*.

The dummy pad 12*d* may be connected to a dummy via 18*c* extending in the thickness direction of the substrate 10. For example, the dummy via 18*c* may extend from a first surface of the substrate 10 to a second surface of the substrate 10, and the dummy via 18*c* may be connected to a dummy wiring layer 16*c* on the second surface of the substrate 10.

The dummy via 18*c* may be disposed in parallel with the feeding via 18*a* connected to the feeding pad 12*c*. The feeding via 18*a* may be connected to a feed wiring layer 16*a* to provide a feed signal to the feeding pad 12*c,* while the dummy via 18*c* is provided separately from the feed wiring layer 16*a*.

In an example, the dummy via 18*c* is connected to a lower surface of the radiating portion 130*a* through the dummy pad 12*d,* to form an additional resonance frequency in addition to an inherent resonance frequency of the chip antenna 100, thereby enlarging the pass band.

More specifically, the chip antenna 100 can form a second resonance frequency due to a channel formed through the feed wiring layer—feeding via—radiating portion—dummy via, in addition to a first resonance frequency formed due to a channel inside the chip antenna 100.

Figure 8:
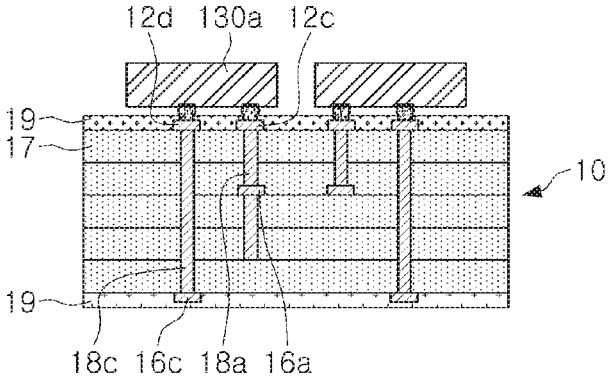
FIG. 8, FIG. 9, and FIG. 10 are cross-sectional views of a chip antenna module according to various examples, taken along line III-III' of FIG. 1.
Figure 9:
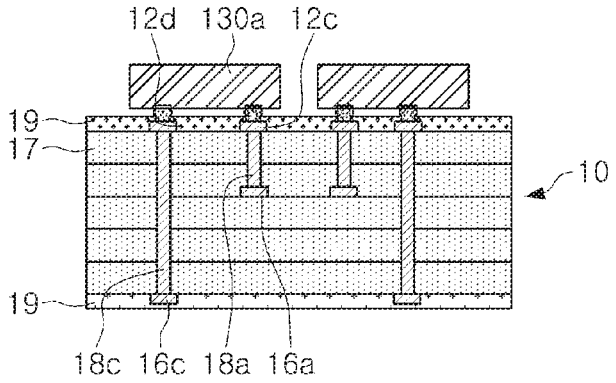
Figure 10:
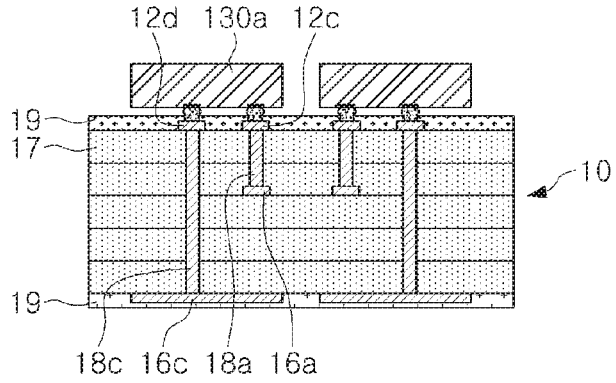

FIG. 8 through FIG. 10 are cross-sectional views of a chip antenna module according to various examples, taken along line III-III' of FIG. 1.

Since the chip antenna modules according to an example illustrated in FIG. 8, FIG. 9, and FIG. 10, are similar to the chip antenna module illustrated in FIG. 7, the same or similar features or elements to those previously described with reference to FIG. 7 will be omitted in the following description for increased brevity.

Referring to FIG. 8, the feeding via 18*a* according to the present example passes through the feed wiring layer 16*a* and extends towards the second surface of the substrate 10. Two resonance frequencies of a wireless frequency signal output from the chip antenna 100 may be determined by an extended length of the feeding via 18.

In an example, since the feeding via 18*a* is disposed to pass through the feed wiring layer 16*a* and further extends toward the second surface of the substrate 10, resonance frequencies can be more conveniently modified.

Although in FIG. 7 and FIG. 8, the dummy via 18*c* is illustrated as having a fixed extended length, in some examples, the extended length of the feeding via 18*a* may be fixed while the extended length of the dummy via 18*c* may be varied, or alternatively, the extended lengths of both the feeding via 18*a* and the dummy via 18*c* may be varied.

Referring to FIG. 7 and FIG. 9, in an example, the dummy pad 12*d* and the dummy via 18*c* may be repositioned within the length d2 of the radiating portion 130*a*. For example, referring to FIG. 7, the dummy pad 12*d* and the dummy via 18*c* may be disposed in a center of the radiating portion 130*a* in a length direction of the radiating portion 130*a*. Referring to FIG. 9, the dummy pad 12*d* and the dummy via 18*c* may be disposed in one end portion of the radiating portion 130*a* in a length direction of the radiating portion 130*a*.

In FIG. 7 and FIG. 9, the feeding pad 12*c* and the feeding via 18*a* are illustrated as being affixed to the other end portion of the radiating portion 130*a* in a length direction of the radiating portion 130*a,* however, depending on examples, positions of the dummy pad 12*d* and the dummy via 18*c* may be varied, or the positions of the feeding pad 12*c* and the feeding via 18*a* may be varied. Alternatively, all of the feeding pad 12*c,* the feeding via 18*a,* the dummy pad 12*d,* and the dummy via 18*c* may be changed in some examples.

Two resonance frequencies of a wireless frequency signal output from the chip antenna 100 may be determined by a distance between the feeding via 18*a* and the dummy via 18*c*. In an example, the resonance frequencies can be conveniently modified by controlling the distance between the feeding via 18*a* and a dummy via 18*c*.

Referring to FIG. 7 and FIG. 10, the length of the dummy wiring layer 16*c* connected to the dummy via 18*c* can be varied. For example, referring to FIG. 7, the length of the dummy wiring layer 16*c* may be identical to a length of the dummy pad 12*d*. Alternatively, referring to FIG. 10, the length of the dummy wiring layer 16*c* may be identical to a length of the radiating portion 130*a*. Depending on examples, the length of the dummy wiring layer 16*c* may be greater than the length of the dummy pad 12*d* and smaller than the length of the radiating portion 130*a*. Alternatively, the dummy wiring layer 16*c* may be formed to have a length smaller than the length of the dummy pad 12*d*, or may be formed to have a length greater than the length of the radiating portion 130*a*.

The two resonance frequencies of the wireless frequency signal output from the chip antenna 100 may be determined by an extended length of the dummy wiring layer 16*c*. According to an example, the resonance frequencies can be conveniently modified by controlling the extended length of the dummy wiring layer 16*c*.

Figure 11:
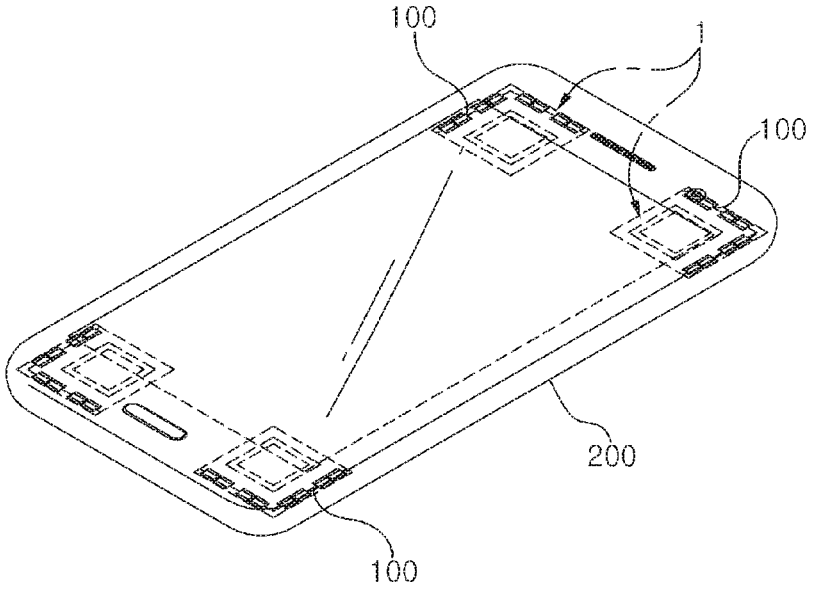
FIG. 11 is a schematic perspective view of a portable terminal device in which a chip antenna module according to an example is mounted.

FIG. 11 is a schematic perspective view illustrating a portable terminal in which an antenna module of the present example is mounted.

Referring to FIG. 11, antenna modules 1 of the present example are disposed at corner areas of a portable terminal 200. More specifically, the antenna modules 1 are disposed such that the chip antennas 100 are adjacent to the corners of the portable terminal 200.

The present example describes a case in which the antenna modules 1 are disposed at all four corners of the portable terminal 200, but an arrangement of the antenna modules is not limited thereto and may be variously modified. For example, if there is insufficient space inside the portable terminal, only two antenna modules may be disposed in corners facing each other in a diagonal direction of the portable terminal. Furthermore, the antenna module is coupled to the portable terminal such that the feed region is adjacent to an outer edge of the portable terminal. Accordingly, radio waves radiated through the chip antennas of the antenna modules are radiated toward the sides of the portable terminal in a direction of the surface of the portable terminal. In addition, the radio waves radiated through the patch antennas of the antenna modules are radiated in a thickness direction of the portable terminal.

The chip antenna module may use the chip antenna instead of the wiring type dipole antenna, thereby significantly reducing the size of the module. Further, transmission/reception efficiency may be improved.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A chip antenna module comprising:

a substrate comprising a feed wiring layer configured to provide a feed signal, a feeding via connected to the feed wiring layer, and a dummy via separated from the feed wiring layer; and a chip antenna disposed on a first surface of the substrate and comprising a body portion formed of a dielectric substance, a radiating portion that extends from a first surface of the body portion and is connected to the feeding via and the dummy via, and a grounding portion that extends from a second surface of the body portion opposite the first surface of the body portion.

2. The chip antenna module of claim 1, wherein the chip antenna is configured to output a wireless frequency signal having two resonance frequencies.

3. The chip antenna module of claim 1, wherein the feeding via passes through the feed wiring layer and extends toward a second surface of the substrate opposite the first surface of the substrate.

4. The chip antenna module of claim 3, wherein two resonance frequencies of a wireless frequency signal output from the chip antenna are determined by an extended length of the feeding via.

5. The chip antenna module of claim 1, wherein the feeding via and the dummy via are spaced apart from each other in an extending direction of the radiating portion, and the feeding via and the dummy via are connected in parallel with the radiating portion.

6. The chip antenna module of claim 5, wherein two resonance frequencies of a wireless frequency signal output from the chip antenna are determined by a distance between the feeding via and the dummy via.

7. The chip antenna module of claim 5, wherein the dummy via is bonded to a dummy wiring layer disposed on a second surface of the substrate opposite the first surface of the substrate and extending along the second surface of the substrate.

8. The chip antenna module of claim 7, wherein two resonance frequencies of a wireless frequency signal output from the chip antenna are determined by an extended length of the dummy wiring layer.

9. The chip antenna module of claim 1, wherein the feeding via is connected to the radiating portion through a feeding pad disposed on the first surface of the substrate and bonded to the radiating portion, and the dummy via is connected to the radiating portion through a dummy pad disposed on the first surface of the substrate and bonded to the radiating portion.

* * * * *